US008015849B2

(12) United States Patent
Jones et al.

(10) Patent No.: US 8,015,849 B2
(45) Date of Patent: Sep. 13, 2011

(54) METHOD OF FORMING METAL

(75) Inventors: Allen M. Jones, Sidney, OH (US); Dale E. Whetstone, Saint Marys, OH (US); Larry A. Wilkerson, Wapakoneta, OH (US); Stephen C. Hatkevich, Maumee, OH (US)

(73) Assignee: American Trim, LLC, Lima, OH (US)

( * ) Notice: Subject to any disclaimer, the term of this patent is extended or adjusted under 35 U.S.C. 154(b) by 462 days.

(21) Appl. No.: 12/301,308

(22) PCT Filed: Oct. 7, 2008

(86) PCT No.: PCT/US2008/079043

§ 371 (c)(1),
(2), (4) Date: Dec. 10, 2008

(87) PCT Pub. No.: WO2009/048865

PCT Pub. Date: Apr. 16, 2009

(65) Prior Publication Data

US 2010/0175446 A1 Jul. 15, 2010

Related U.S. Application Data

(60) Provisional application No. 60/978,160, filed on Oct. 8, 2007, provisional application No. 61/049,082, filed on Apr. 30, 2008, provisional application No. 61/059,841, filed on Jun. 9, 2008.

(51) Int. Cl.
*B21D 26/14* (2006.01)
*B21D 26/06* (2006.01)

(52) U.S. Cl. ..... 72/56; 72/54; 72/60; 72/707

(58) Field of Classification Search ..... 72/54, 56, 72/57, 60, 430, 705, 707
See application file for complete search history.

(56) References Cited

U.S. PATENT DOCUMENTS

| | | | | |
|---|---|---|---|---|
| 1,974,839 | A | 9/1934 | Silliman | |
| 2,726,970 | A | 12/1955 | Toth | |
| 3,825,819 | A * | 7/1974 | Hansen et al. | 73/150 A |
| 4,116,031 | A * | 9/1978 | Hansen et al. | 72/56 |
| 4,400,226 | A | 8/1983 | Horrigan | |
| 4,986,102 | A * | 1/1991 | Hendrickson et al. | 72/56 |
| 6,050,121 | A | 4/2000 | Daehn et al. | |
| 6,138,809 | A | 10/2000 | Kinoshita et al. | |
| 6,227,023 | B1 * | 5/2001 | Daehn et al. | 72/57 |
| 6,627,835 | B1 | 9/2003 | Chung et al. | |
| 2007/0181855 | A1 | 8/2007 | Nagao et al. | |

* cited by examiner

*Primary Examiner* — David Jones
(74) *Attorney, Agent, or Firm* — Rankin, Hill & Clark LLP

(57) ABSTRACT

Electromagnetic forming can lead to better formability along with additional benefits. The spatial distribution of forming pressure in electromagnetic forming can be controlled by the configuration of the actuator. A type of actuator is discussed which gives a uniform pressure distribution in forming. It also provides a mechanically robust design and has a high efficiency for flat sheet forming.

20 Claims, 12 Drawing Sheets

METHOD OF FORMING METAL

CROSS-REFERENCE TO RELATED APPLICATIONS

This application is related to U.S. provisional utility application Nos. 60/978,160, filed Oct. 8, 2007, entitled METHOD OF FORMING METAL; 61/049,082 filed on Apr. 30, 2008, entitled EMF ACTUATOR AND COUPLING SYSTEM, and 61/059,841, filed Jun. 9, 2008, entitled METHOD OF FORMING METAL, the entireties of all of which are incorporated herein by reference.

BACKGROUND OF THE INVENTION

1. Field of Invention

The invention concerns high velocity metal forming (HVMF). More particularly, the invention relates to a magnetic coil assembly (actuator) for use in electromagnetic forming as a reliable alternative to traditional metal-stamping or metal-forming operations. A method of using the actuator is also contemplated.

2. Description of Related Art

Electromagnetic forming is a method of forming sheet metal or thin walled tubes that is based on the method of placing a work-coil in close proximity to the metal to be formed and running a brief, high intensity current pulse through the coil. If the metal to be formed is sufficiently conductive the change in magnetic field produced by the coil will develop eddy currents in the workpiece. These currents also have associated with them a magnetic field that is repulsive to that of the coil. This natural electromagnetic repulsion is capable of producing very large pressures that can accelerate the workpiece at high velocities (typically 50-500 meters/second). This acceleration is produced without making physical contact with the workpiece. The electrical current pulse is usually generated by the discharge of a capacitor bank. It can provide: improved formability, improved strain distribution, reduction in wrinkling, active control of springback and the possibility of local coining and embossing.

Electromagnetic forming can be carried out on a wide range of materials and geometries within some fundamental constraints. First, the material must be sufficiently electrically conductive to exclude the electromagnetic field of the work-coil. The physics of this interaction have been well characterized.

The efficiency of electromagnetic forming is directly related to the resistance of the workpiece material. Materials which are poor conductors can only be effectively formed with electromagnetic energy if an auxiliary driver plate of high conductivity is used to push the workpiece.

Electromagnetic forming of axis-symmetric parts, using either compression or expansion solenoid type forming coils is presently the most widely used of the electric pulse energy methods. The common application is for the swaging of tubular components onto coaxial mating parts for assembly. Not as common is non-symmetric forming that concerns the forming of shell or dish shapes within a forming die using workpieces comprising flat sheets of metal.

If conventional electromagnetic forming coils are used in non-symmetric forming, the electromagnetic pressure distribution must be appropriate for the part being formed. It has been found that the velocity distribution within the sheet metal during forming significantly influences the result. Puckers or other defects can form when the launch velocity of the metal workpiece is not uniform.

In principle, as shown in FIG. 1, an axis-symmetric electromagnetic forming system consists of a capacitor bank 1, a conductive actuator 2 and the metallic workpiece 3 to be deformed, and the forming die 4 that has a die cavity 5 provided in one of its surfaces.

The capacitor bank 1 is connected to the actuator 2, which is located near the workpiece 3 and the die 4. When the main switch is closed, the large current through the actuator 2 produces a transient magnetic field that induces eddy currents in the nearby metallic workpiece 3. The currents in the actuator 2 and the metallic workpiece 3 travel in opposite directions, according to Lenz's Law. The electromagnetic repulsion between the oppositely flowing currents, governed by the Lorentz force, provides the deformation force to the workpiece 3, forcing it against the surface of the die 4 such that the workpiece assumes the shape of the die cavity 5 thereby providing a formed part.

High velocity forming methods have had a recent resurgence in interest due to the need for greater use of aluminum alloys and specialty metals such as stainless steel in the automotive industry. Weight savings, concomitant fuel efficiency increases and superior recyclability have driven the increased interest in aluminum in the automotive industry. Stainless steel is of great interest to the automotive industry because of its use in the construction of fuel cells.

Press forming of aluminum alloys and specialty steels has presented challenges, relative to low carbon steel, principally due to the very low strain rate hardening, low r (strain ratio) value and high galling tendency of such materials. Low carbon steels have significant strain rate sensitivity which is identifiable by a long arching stress-strain curve. Wrinkling, splits and other defects can occur in aluminum panels within the first 25% of the tool stroke using conventional forming techniques. Stainless steel and other specialty steels are also subject to cracking (breakage), and they can contribute to excessive tool wear when conventional forming techniques are employed.

To date, the use of non-symmetric forming has not been commercially feasible for most applications because the actuators have displayed minimal life. In most cases, actuators are capable of forming only one part before they fail. Actuators are relatively expensive to produce, and limited actuator life makes non-symmetric forming too costly.

The present invention provides a novel actuator and a method of non-symmetric forming that overcomes many of the disadvantages that are experienced using prior art forming techniques.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

SUMMARY OF THE INVENTION

A first embodiment of the invention is an actuator, which is a coil assembly, for use in high velocity metal forming comprising an inner coil and an outer coil. The inner coil generally has the shape of a flattened helix, and the outer coil includes a cavity therein. The inner and outer coils are generally coaxial. Leads connect the inner coil to an outside electrical power source. A resin coats the inner coil, and the inner coil is situated inside the cavity of the outer coil such that the inner and outer coils are not in electrical contact with one another, and such that the cavity of the outer coil is substantially filled with the resin.

A second embodiment of the invention is a process for making a high velocity metal forming (HVMF) actuator assembly wherein the assembly comprises an inner and an outer coil, the process comprising:

a. forming a hole through a block of conductive metal or alloy having X, Y, and Z dimensions, said hole being formed in the Z dimension;
b. beginning at the hole, cutting out a continuous central portion of the block corresponding to a desired inner dimension of an inner coil, said cutting being substantially parallel to the Z-axis;
c. cutting out a further portion of the block parallel to the Z-axis to form an inner coil, the remainder constituting an outer coil having a cavity;
d. machining angled notches in a +Z portion of the inner coil at regular intervals along the X-axis, said angled notches being cut at an angle of 0 to 90° from the X-axis;
e. machining straight slots in a −Z portion of the inner coil, said straight slots being substantially parallel to the Y-axis, to afford an inner coil;
f. contacting the inner coil with a solution capable of removing surface oxidation therefrom;
g. inserting the inner coil into the cavity of the outer coil, and
h. filling the space of the cavity of the outer coil and surrounding the inner coil with a resin.

Another embodiment of the invention is a process of forming metal comprising: (a) selecting a workpiece having a composition, (b) selecting a compatible HVMF actuator assembly including a power source, (c) selecting a forming die, (d) spatially arranging the workpiece, coil assembly, and die, and (e) applying power to the power source of the coil assembly to deform the workpiece.

Still another embodiment of the invention is a metal forming system including: (a) the any coil assembly or actuator disclosed herein, (b) a hydraulic press, and (c) a continuous feed apparatus for feeding a plurality of workpieces into a working area within a magnetic field generated by the coil assembly.

Other embodiments of the invention include a HVMF actuator made by any processes disclosed elsewhere herein and processes of forming metal using any high velocity metal forming (HVMF) actuator assembly disclosed elsewhere herein. Such inventive forming processes include non-symmetrical forming processes.

BRIEF DESCRIPTION OF THE DRAWINGS

FIGS. 5 A, B, and C are not to the same scale.

DETAILED DESCRIPTION OF THE INVENTION

Figure 1:
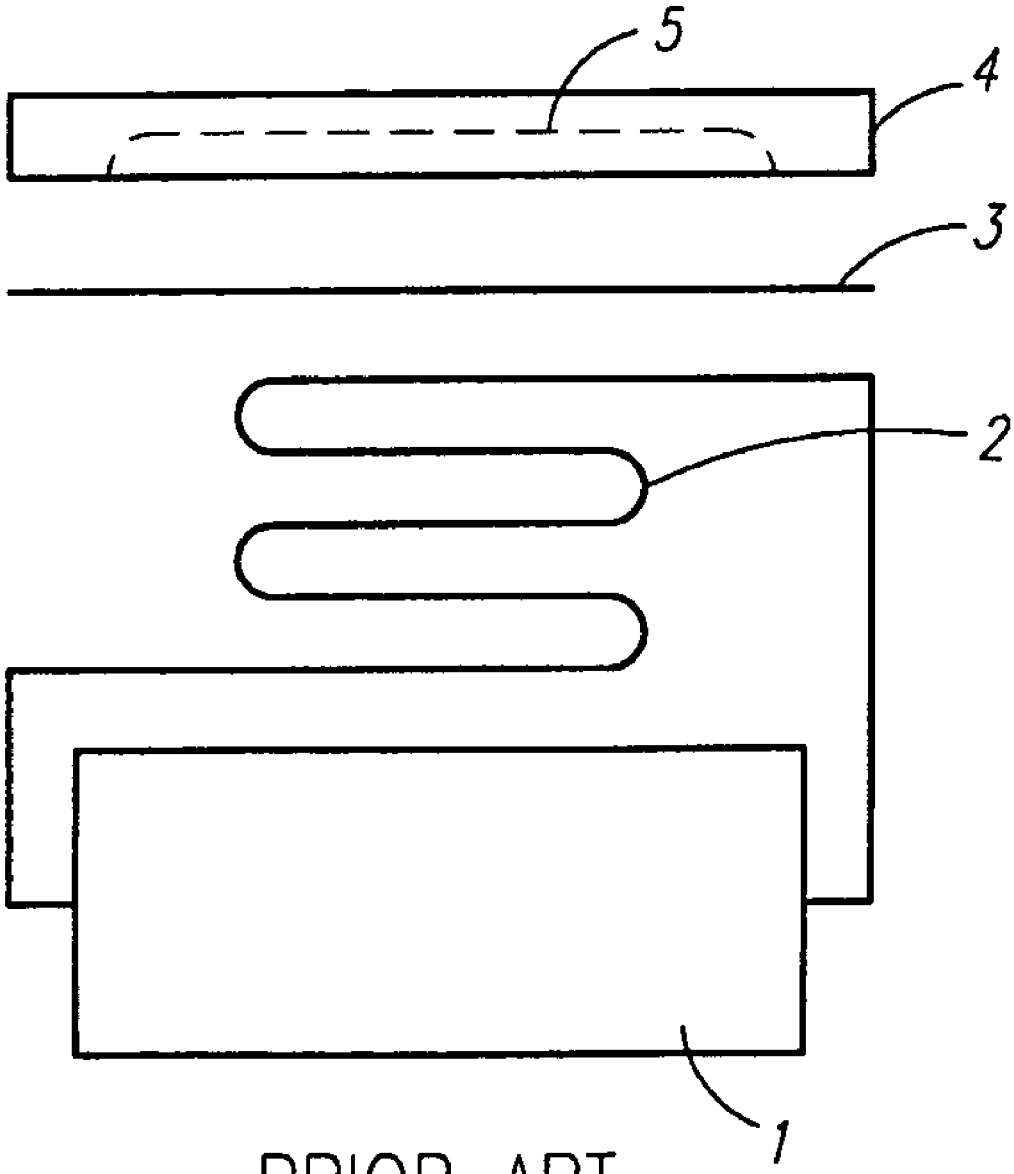
PRIOR ART Fig.1
FIG. 1 is a generalized schematic diagram of a prior art electromagnetic forming coil system.

High velocity metal forming (HVMF) provides a means for producing products which would otherwise be prohibitively expensive or complex using traditional manufacturing methods. In order to incorporate HVMF as a reliable manufacturing method, HVMF coils must be designed to produce uniform and repeatable results after hundreds of work cycles. For example, desirable coil design requirements include: the ability to withstand repeated discharges from a capacitor bank; compatibility with products that will be produced using HVMF; generation of a uniform force; minimal or no arcing during capacitor discharge; ease of manufacture, including use of traditional manufacturing methods. Compatibility means that the materials from which the actuator is fabricated can in large part be determined by the type of metal to be formed by the coil.

Upon activation of the electromagnetic actuator by providing a current pulse from a capacitor bank controlled by a suitable actuator controller, the intense electromagnetic field of the actuator generates a repulsive electromagnetic force between the actuator and the workpiece. The magnitude of the repulsive force is a function of a variety of factors including the conductivity of the workpiece and, where an inductive coil is employed as the actuator, the number of turns of the actuator coil. An actuator can be driven by the controlled periodic discharge of a capacitor, generating short, high voltage, high current electrical discharges through a conductive coil of the actuator.

The HVMF actuator of the invention may assume a variety of configurations including those that comprise an inductive coil. Suitable inductive coils include those that are configured as a multi-loop coil that is substantially helical. It is further contemplated that suitable helical coils may define a variety of geometries including substantially circular, ellipsoidal, parabolic, quadrilateral, and planar geometries, and combinations thereof.

The HVMF actuator of the invention can be operated to yield strain rates of about 1000/sec, or at least about 500/sec, or at least about 250/sec, or at least about 100/sec, and sheet velocities exceeding about 50 msec, or at least about 25 m/sec, or at least about 10 m/sec. At such strain rates and sheet velocities, many materials that typically exhibit low formability at lower strain rates and sheet velocities transition to a state of hyper-plasticity characterized by relatively good formability.

Aluminum, aluminum alloys, magnesium, and magnesium alloys are good examples of such materials. In many instances, materials deformed according to the present invention also exhibit reduced springback, where a deformed material tends to return partially to its original, un-deformed shape. As a result, it is often not necessary to compensate for springback in the deforming process.

A first embodiment of the invention is an actuator, which is a coil assembly, for use in high velocity metal forming comprising an inner coil and an outer coil. The inner coil generally has the shape of a flattened helix, and the outer coil includes a cavity therein. The inner and outer coils are generally coaxial. Leads connect the inner coil to an outside electrical power source. A resin coats the inner coil, and the inner coil is situated inside the cavity of the outer coil such that the inner and outer coils are not in electrical contact with one another, and such that the cavity of the outer coil is substantially filled with the resin. The inventors hereof believe that the use of a flattened helix is important to generate a non-uniform magnetic field (leading to non-symmetric forming operations) as opposed to a cylindrical helix, which generates a uniform magnetic field leading to symmetric forming operations.

A preferred embodiment is a uniform pressure activator ("Uactivator") which carries out non-symmetric forming of metals and other compositions.

A second embodiment of the invention is a process for making a high velocity metal forming (HVMF) actuator assembly wherein the assembly comprises an inner and an outer coil, the process comprising:

a. forming a hole through a block of conductive metal or alloy having X, Y, and Z dimensions, said hole being formed in the Z dimension;
b. beginning at the hole, cutting out a continuous central portion of the block corresponding to a desired inner dimension of an inner coil, said cutting being substantially parallel to the Z-axis;
c. cutting out a further portion of the block parallel to the Z-axis to form an inner coil, the remainder constituting an outer coil having a cavity;
d. machining angled notches in a +Z portion of the inner coil at regular intervals along the X-axis, said angled notches being cut at an angle of 0 to 90° from the X-axis;
e. machining straight slots in a −Z portion of the inner coil, said straight slots being substantially parallel to the Y-axis, to afford an inner coil;
f. contacting the inner coil with a solution capable of removing surface oxidation therefrom;
g. inserting the inner coil into the cavity of the outer coil, and
h. filling the space of the cavity of the outer coil and surrounding the inner coil with a resin.

Yet another embodiment of the invention is a process of forming metal comprising: (a) selecting a workpiece having a composition, (b) selecting a compatible HVMF actuator assembly including a power source, (c) selecting a forming die, (d) spatially arranging the workpiece, coil assembly, and die, and (e) applying power to the power source of the coil assembly to deform the workpiece.

Other embodiments of the invention include a HVMF actuator made by any processes disclosed elsewhere herein and processes of forming metal using any HVMF actuator assembly disclosed elsewhere herein. Such inventive forming processes include non-symmetrical forming processes.

Metal. Generally, any conductive metal or alloy can be used to form the actuator of the invention. Copper typically has the best combination of conductivity and toughness required to withstand the forces generated in electromagnetic forming. However, when coupled with beryllium, the resulting beryllium-copper alloy ("BeCu") displays improved strength and durability. For example, the actuator of any embodiment of the invention may include about 0.1 to about 2 wt % beryllium and about 95 to about 99.5 wt % copper, preferably about 0.2 to about 0.7 wt % of beryllium and about 97 to about 99 wt % copper. More preferably, the actuator of the invention is fabricated from BeCu Alloy 3 from Brush Wellman Inc., Elmore, Ohio. Generally, the electrical conductivity (i.e., the metal used) of the workpiece will dictate the material from which the actuator is fabricated. This relationship falls under the concept of "compatibility."

Whatever metal is used, the inventors have discovered that fabrication of an actuator of the invention by cutting the inner coils from a single block of metal (or alloy) helps to ensure generation of a uniform magnetic field.

Dies. Many non-conductive dielectric materials may be used as dies for forming or shaping thin metal workpieces. Polycarbonate and phenolic plastics, for example, are suitable materials. In a preferred embodiment of the present invention, the die is comprised of a ceramic such as aluminum oxide. Ceramics are especially suitable owing to their high mechanical strength and high heat conductivity compared to most dielectric materials such as glass or plastic. This feature of ceramics can be beneficial for metal forming which involves a high repetition rate for the metal forming pulses as is required in any economically feasible (i.e., high-volume) production process, for example, in the fabrication of aluminum beverage containers. Because both electrical energy dissipated by the coil and kinetic energy transferred by the workpiece must be absorbed by the die, the rate of heat transfer out of the system through the die can limit the pulse repetition rate. Die materials which are good conductors of heat are therefore especially preferred.

Holders. The apparatus of the present invention may also include a workpiece holder to hold the workpiece during forming. Such a workpiece holder may be in the form of a male or female mold body defining a mold shape against which the metal workpiece is deformed. The apparatus may also have a workpiece holder which comprises a first half adapted to fit along a third side of the actuator (where the return conduits are on respective first and second sides) so as to hold the metal workpiece between the actuator and the first half, and a second half adapted to fit along a fourth side of the actuator opposite the third side. The workpiece holder may also be the outer coil itself. The workpiece may alternatively be secured in a position over the die cavity by clamping devices or vacuum holding devices, or by means of a magnetic holding system.

Dielectric Coating. A variety of dielectric materials may be used to coat the inner coil, thus preventing electrical contact between the inner and outer coils. For example, glasses, ceramics, enamels, and plastics. A slurry, paste or frits—of glass, ceramics or enamels—may be coated by conventional means onto the inner coil, such as by dipping, spray drying, doctor blading, etc. The coil is then heated sufficiently to fuse the frits into a cohesive coating layer. Dielectrics including $BaTiO_3$, $SiO_2$ and transition metal oxides, and combinations thereof, may be used for this purpose.

Other possible dielectric coating materials include thermoplastics such as fluoropolymers, polyethylenes, polyesters; thermoset powder coatings; 2K epoxy systems; dual cure systems; mixtures of epoxies with other resins; lower temperature curable epoxies; and UV-curable epoxies. In a preferred embodiment, the dielectric material comprises a bisphenol-A epoxy resin. In particular, the dielectric material may include a nine-type bisphenol-A epoxy resin and a one-type bisphenol-A epoxy resin. The weight ratio between the nine-type bisphenol-A epoxy resin and the one-type bisphenol-A epoxy resin may be about 6:1 to about 2:1, preferably about 5:1 to about 3:1 and more preferably about 4:1.

The dielectric material may advantageously further comprise a cross linker. A preferred crosslinker includes a urea-formaldehyde resin. The weight ratio of the bisphenol-A epoxy resin(s) to the crosslinker is about 10:1 to about 2:1, preferably about 8:1 to about 4:1, and more preferably about 6:1.

In a preferred embodiment, the dielectric coating includes at least one bisphenol-A epoxy resin. In an especially preferred embodiment, a ratio of about 4 parts of a nine-type bisphenol-A epoxy resin to 1 part of a "one type" bisphenol-A epoxy resin is used. The resins are crosslinked with a urea-formaldehyde resin. The ratio is about 6 parts epoxy to one part urea-formaldehyde resin, the ratio based on solids. For the overall dielectric coating formulation, including bisphenol-A resins and crosslinkers, a large portion is the solvent, for example about 40 to about 80 wt %, about 50 to about 75 wt % or about 50 to about 70 wt %. In a preferred embodiment, the formula is approximately 55% solvent with a ratio of three parts DPM to one part glycol ether EB. Four percent of the solvent is a 3 to 1 ratio of N-butanol and ethanol in which the urea-formaldehyde crosslinker is dissolved.

Useful peroxide curing-agents include methyl ethyl ketone peroxide, hydroperoxide, paramenthane hydroperoxide, t-butyl hydroperoxide, diisopropyl benzene hydroperoxide, and combinations thereof.

In a preferred embodiment, the dielectric composition is a reaction product of four constituents with a crosslinking agent and an epoxy curing agent, as follows:

Constituent A (resin) (16.7 wt %) is a low molecular weight solid epoxy resin derived from a liquid epoxy resin and bisphenol-A having an epoxide equivalent weight of 525-550. The liquid epoxy resin is a condensation product of 2,2-bis(p-glycidyloxphenyl) propane with 2,2-bis(p-hydroxyphenyl) propane and similar isomers.

Constituent B (epoxy resin): (16.7 wt %) is the diglycidyl ether of bisphenol-A (100% wt) having a maximum epichlorohydrin content of 1 ppm.

Constituent C (glycidyl Ester): (16.7 wt %) is glycidyl neodecanoate (99.9%) having a maximum diglycidyl ether content of 1000-1500 ppm.

Constituent D (di-amine): (45 wt %) is polyoxypropylene diamine (60-100%).

Constituent E (crosslinking agent): (3 wt %) is a liquid form of hexamethoxymethylmelamine (>98% non-volatile).

Constituent F (Epoxy curing agent): (2 wt %) is a low molecular weight solid epoxy resin (epoxide equivalent weight 525-550) including 2,2',2"-nitrilo-tris-ethanol (65-80%), piperazine (20-35%) and N-aminoethylpiperazine (10-20 wt %).

The coils are dipped in the dielectric coating composition and cured at 300° F. for 30 minutes. Physical testing performed on the so-coated coils includes pencil adhesion, scribe, MEK rubs, and impact testing.

Epoxies having product numbers such as CM-300, GB-112, JS-003, JS-013, and JS-017, available from Allchem Industries of Gainsville, Fla. Such epoxies may optionally be diluted with a solvent such as an alcohol or ether, or aromatic hydrocarbon solvent. For example suitable solvents include toluene, xylene, phenol, methanol, ethanol, propanol (all forms), butanol (all forms), glycol, glycol ethers, and glycol ether dibenzoate. Any form of the named alcohols and aromatic compounds (including n-, iso-, tert-, ortho-, meta-, and para, each where applicable) are envisioned. Particularly preferred are toluene and n-butanol.

Encapsulant/Infiltrant. Thermoplastics, elastomers, and thermoplastic elastomers ("TPEs") can be used to fill the space between the inner and outer coils of the invention, as well as, in certain embodiments, completely surround the outer coil. The fill is useful for absorbing forces generated by the coil, heat dissipation, and acting as an insulator (dielectric), between the inner and outer coils.

Useful thermoplastics include polypropylene, polyethylene, nylon, and polycarbonate, among others. An advantage of thermoplastic fill is that, if the coil or the thermoplastic fill becomes damaged or deformed, the thermoplastic may be heated to melt it away. The coil can then be repaired, and/or new thermoplastic may be injection molded to form a fresh resin fill. Thus, the life of the coil can be extended, because the fill is sacrificial and replaceable.

Elastomers are also suitable as the fill resin of the invention, for example thermosetting polyurethane elastomers and toluene diisocyanate terminated polyether prepolymers. The elastomers may be cured.

Useful fill elastomers include urethanes, polyesters, silicones, isocyanurates, acrylates, rubbers, epoxides, polyamides, and novolaks. The rubber may be any of silicone rubber, nitrile rubber, EPDM, EPM, isoprene, neoprene, butyl rubber, and combinations thereof. In a preferred embodiment, the elastomer comprises thermosettable urethane. For curable elastomers, suitable curing agents include peroxides, acid-catalysts, and phenolic-formaldehyde resins.

Specific suitable commercially available polymer resins and curing agents include Adiprene™ LF-950A, and Vibracure™ A133, respectively, both available from Chemtura Corporation, Middlebury, Conn. The same solvents involved in thinning and spreading the dielectric coating may be used with respect to applying the plastic encapsulant.

Figure 2:
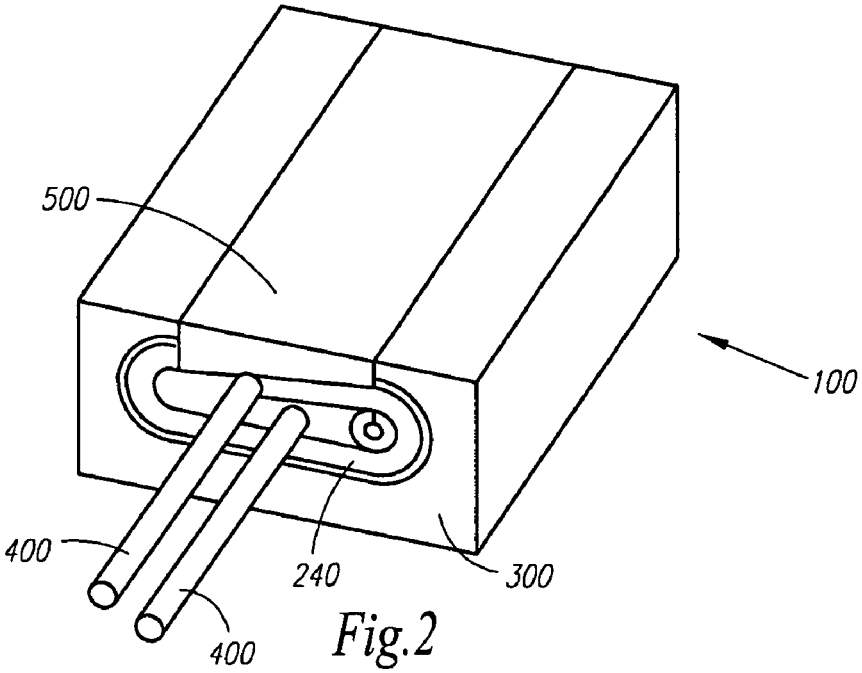
FIG. 2 is a schematic perspective view of an inventive actuator including inner and outer coils with resin within the outer coil and surrounding the inner coil.

Machining Process. The coils of the HVMF actuator assembly of the invention are generally formed from a single block of metal or alloy. It is believed that this provides the coils of the invention with the capability to generate a stable, uniform magnetic field, as well as long cycle life. Referring now to FIG. 2, a finished HVMF actuator of the invention is shown. The major components of the finished assembly include inner coil 240, outer coil 300, leads 400 and resin fill 500.

Figure 3:
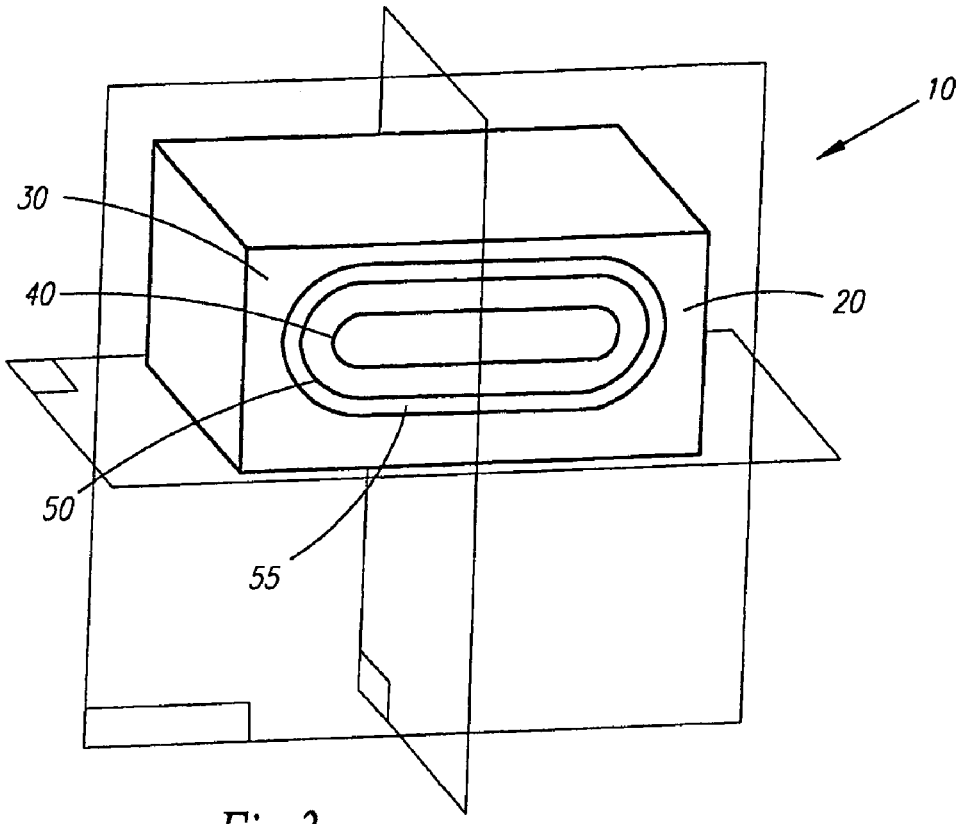
FIG. 3 is a schematic perspective view of a metal block from which the inner and outer coils of the HVMF actuator assembly of the invention is cut.

Referring now to FIG. 3, a block of conductive metal 10, preferably a BeCu alloy is shown. The block 10 is preferably in the shape of a right rectangular solid, however cubes or other right-elliptical solids are possible. The block 10 may also be a sphere, or other solid shape, however in such case, processing steps are unnecessarily complicated. However, for ease of reference, it is assumed that block 10 is a right rectangular solid having dimensions along the X, Y and Z axes. On a flat face 20 of block 10 in the XY plane are drawn or otherwise inscribed intended machining paths 30. Machining paths 30 include inner coil core machining path 40 and inner coil external machining path 50, and outer coil internal machining path 55.

Figure 4:
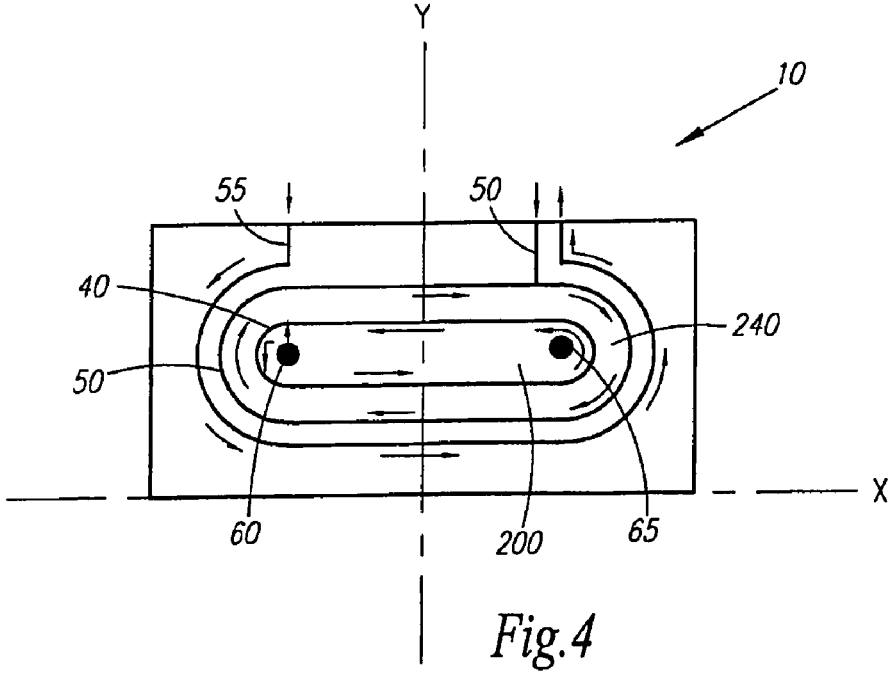
FIG. 4 is a schematic end-on view of the metal block of FIG. 3 with machining paths illustrated.

As seen in FIG. 4, at a suitable point along or near path 40, a hole 60 is drilled as a starting point for the machining Generally, the hole is drilled in a direction through the block that is perpendicular to the long axes (i.e., straight sides) of the coil loops and parallel to the length of the coil as seen from loop to loop. In the case of the right rectangular block 10, the hole 60 is drilled parallel to the Z axis. More than one hole may be so drilled, e.g., holes 60 and 65.

A wire EDM (not shown) is used to cut along inner coil core path 40. The inner coil core 200 can be removed from block 10 for further finishing. Electric Discharge Machining is a process involving an electrode to create a hole or threads in a metal workpiece. Wire Electrical Discharge Machines (Wire EDMs) are machine tools in widespread use for precision metal cutting.

Continuous wire EDMs generally comprise a special electrical discharge wire that is stretched between two guides. The electrical discharge wire extends completely through the workpiece. As the wire and the workpiece are brought into close proximity an arc is struck. The wire and workpiece are moved relative to one another so that the straight wire advances through the workpiece. As the wire is consumed it is slowly moved past the workpiece so that a fresh piece of wire is continuously presented to the workpiece as cutting proceeds. The workpiece is generally immersed in a cutting fluid such as, for example, deionized water. One advantage of a continuous wire EDM process is that the electrode is automatically and continuously replenished as it is consumed. The cut is thus maintained at a predetermined size. A disadvantage of the conventional continuous wire EDM process is that it can not be employed to form a blind hole.

A special type of electrical discharge machine involves an electrode of finite length, which is advanced into a workpiece to form a blind hole. This is sometimes referred to as "sinker" EDM technology. The electrodes can be of any desired cross-sectional configuration, including, for example, round, square, rectangular, hollow, or the like. The cross-section of a hole formed by this sinker EDM technology is generally substantially the same as that of the electrode. In general, the efficient operation of sinker electrodes requires that the electrode be mounted for automatically controlled reciprocal movement relative to the workpiece. The formation of a slot with sinker EDM technology generally requires that the cross-section of the electrode be the same as the cross-sectional shape of the slot. There are practical limits to how long a thin blade like electrode can be and still retain its accuracy. This substantially limits the length of the slots that can be formed with sinker electrodes.

A wire electrical discharge machine such as that available from MC Machinery Systems, Inc., (Mitsubishi) of Wood Dale, Ill. is suitable herein. It will be appreciated that cutting and machining can be carried out with CNC, laser and conventional metal cutting techniques as known in the art.

Figure 5A:
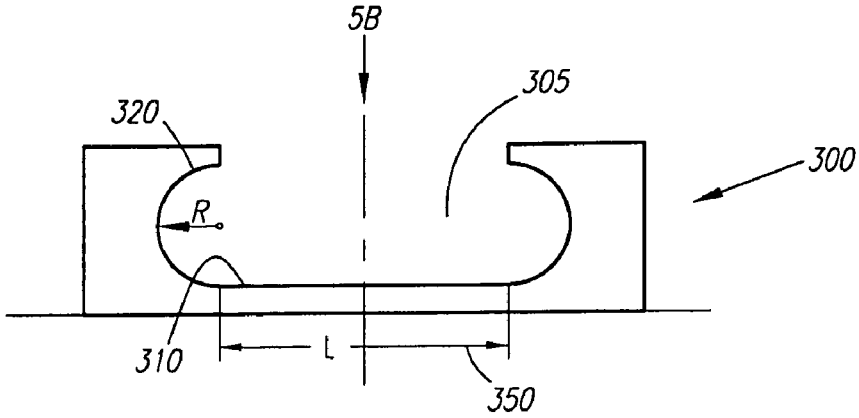
FIG. 5A is a schematic end-on view of the outer coil, from which the inner coil has been removed.
Figure 5B:
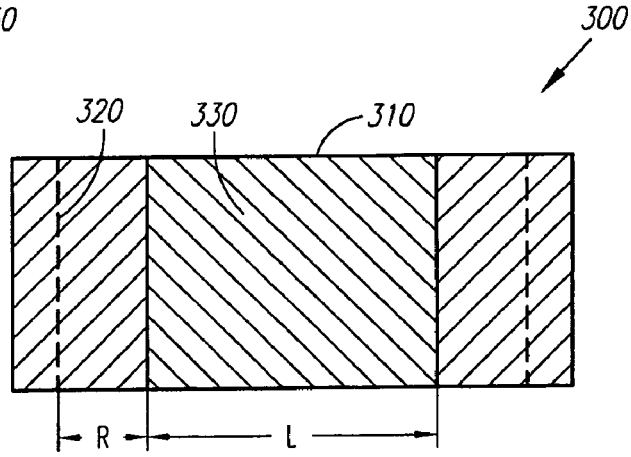
FIG. 5B is a view of FIG. 5A looking along line 5B.

Referring again to FIG. 4, the inner coil 240 is next cut from the block 10 by wire EDM following path 50. Looking to FIG. 5A, the remainder of block 10 is now considered to be outer coil 300, having cavity 305, from which inner coil 240 was removed. Outer coil 300 has, in the X-dimension, an inner long side 350 with length L, and semicircular end 320 having inner radius R. As seen in FIG. 5B, which is a view along line 5B'-5B" in FIG. 5A, a rectangular opening 330 runs the entire Z-dimension length of the outer coil 300 parallel to the XZ plane. Opening 330 also has width L, which corresponds to the dimension of inner side 310.

Figure 6:
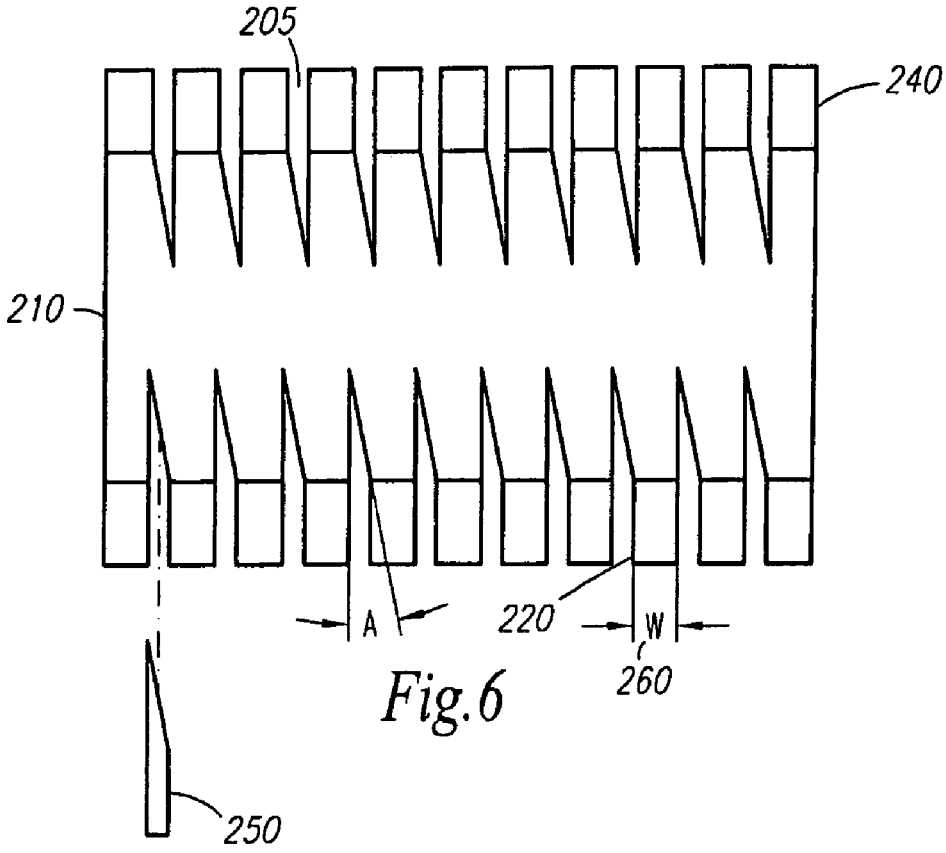
FIG. 6 is a schematic frontal view of the partially finished inner coil from which notches have been cut.
Figure 7:
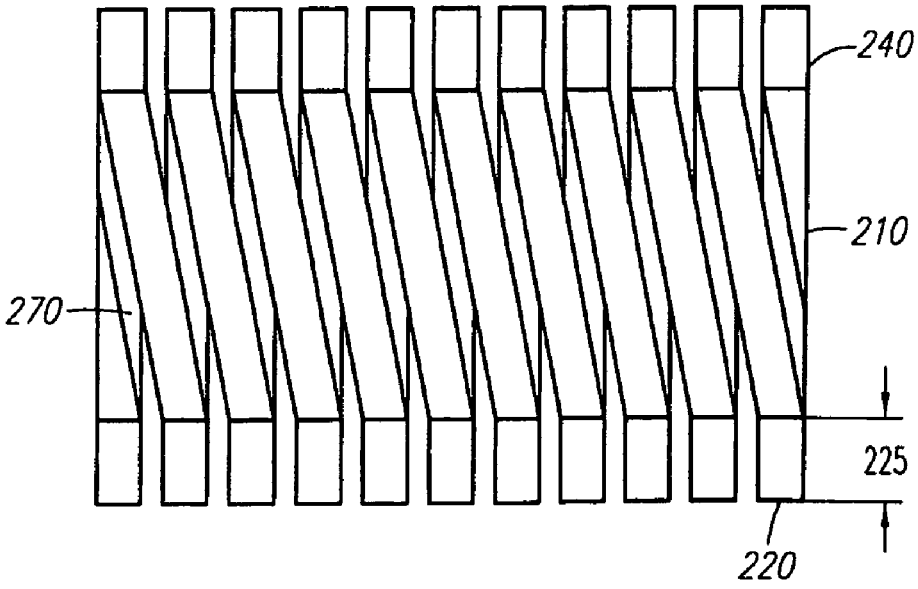
FIG. 7 is a schematic frontal view of the partially finished inner coil showing angled slots machined out.
Figure 8:
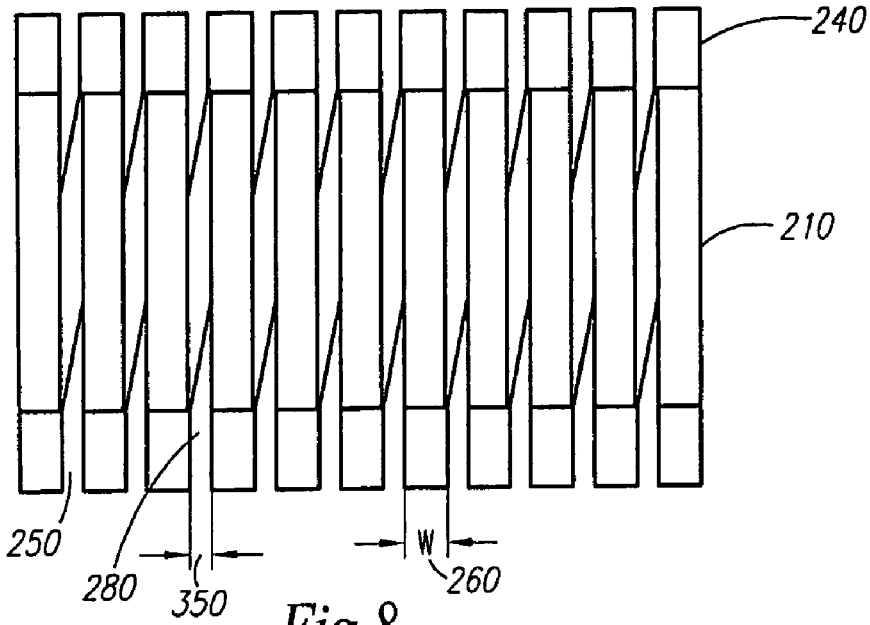
FIG. 8 is a schematic rear view of the partially finished inner coil showing straight slots machined out.

As shown in FIGS. 6-8, the inner coil 240 is further machined to form loops. First, FIG. 6 shows that angled notches are cut out of the inner coil 240. For each loop of the coil, an angled notched portion 250 having angle A with respect to the long side 210 of the loop is cut out.

The angled notches may be cut at an angle of 0° to 90° relative to the X-axis, preferably about 5° to about 85°, and more preferably about 10° to about 80° relative to the X-axis. The resulting angled cuttings 250 are discarded or otherwise reprocessed.

The angled notches may be triangular or have the shape of a trapezoid. If a trapezoid, the width W (260) of the rounded end 220 is constant around the circumference. Looking to FIG. 7, the angled slots 270 are machined out, thereby connecting the notches.

Figure 9:
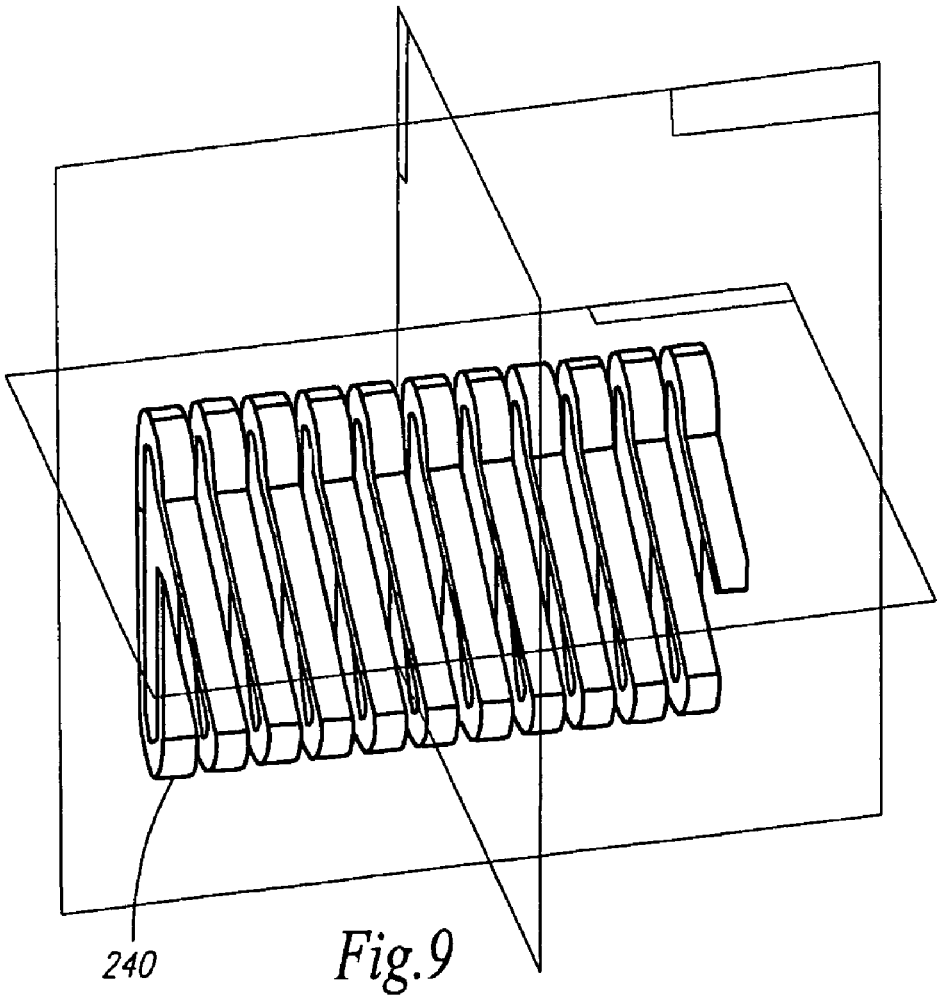
FIG. 9 is a schematic perspective view of the finished inner coil.
Figure 10:
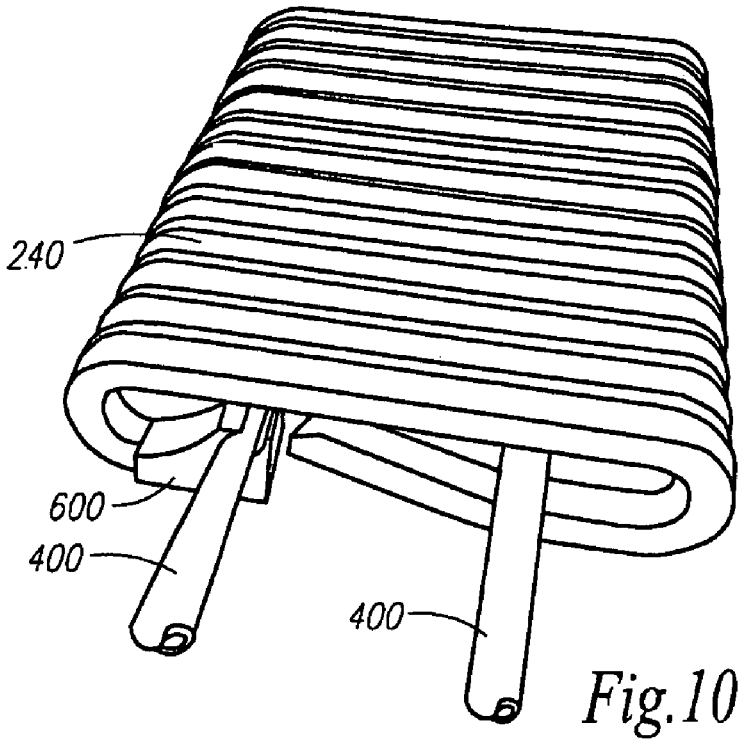
FIG. 10 is a schematic perspective view of an exemplary inner coil, electric leads and connector of the invention.

In FIG. 8, the inner coil 240 is rotated and straight slots 265 are machined into the inner coil 240. The straight slots 280 are machined essentially in the XY plane. Spacing 350 between the coil loops may be greater than, less than, or the same as width W (260). Preferably, the spacing between the loops is uniform. All of the aforementioned cutting may be performed by CNC milling or machining, wire EDM, laser, or other suitable means. FIGS. 8 and 9 show the finished inner coil 240, which is then cleaned by immersion in a dilute acidic solution, and then dipped in, or otherwise coated in at least one layer of a dielectric material and cured or fused as appropriate. FIG. 10 shows an end-on view of a finished coil.

Other suitable cleaning solutions include a mixed $H_2SO_4$—$H_2O_2$ solution and Ridoline®, commercially available from Henkel Corporation, of Rocky Hill, Conn., USA.

Care must be taken to ensure that the inner coil is free of surface defects, burrs, chips, etc. Such defects would serve as points of origin of arcing or stress fractures of the coil or electrical arcing as the coil will both generate and be subject to great tensile stress. Hence the inner coil must be highly polished.

Figure 11:
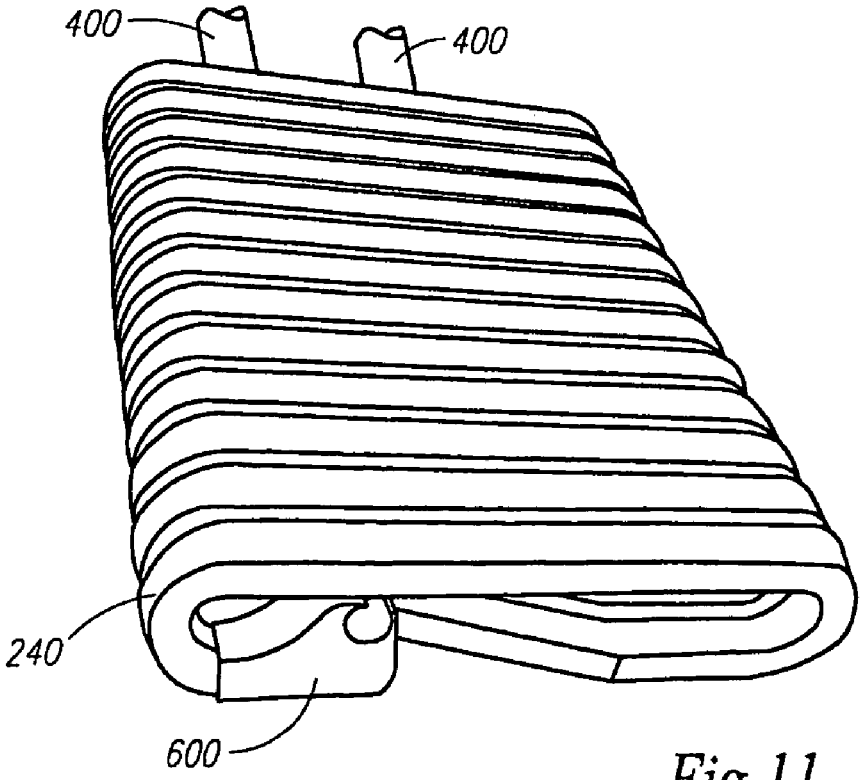
FIG. 11 is an alternate schematic perspective view of an exemplary inner coil, electric leads and connector of the invention.

As shown in FIGS. 10 and 11, leads 400 are connected to each end of the internal coil 240. Care must be taken to ensure that the leads do not come into contact with any part of the coil other than the ends to which they are connected. The connection may be by brazing or by a mechanical connection. The leads may be formed of any conductive metal so long as it can be electrically and physically connected with the metal from which the coils are formed. Preferably, the leads are formed of the same metal or alloy as the coils.

Connector. Alternatively, as shown in FIGS. 10-13, a connector 600 (or 700) can be used to secure leads 400 to the ends of coil 240. Connector 600 is designed such that a lead 400 can attach to an end of a coil 240 distal to a power source without contacting the coil at any other point. A variety of shapes and sizes for connector 600 are possible but a critical factor is that connector 600 provides the only contact point between coil 240 and leads 400. Keeping in mind the shape of the axial ends of a coil as shown in FIGS. 10-11, a connector must accommodate both the electrical lead 400, generally a cylinder, and a portion of the long side 210 of a terminal loop of coil 240.

Figure 12A:
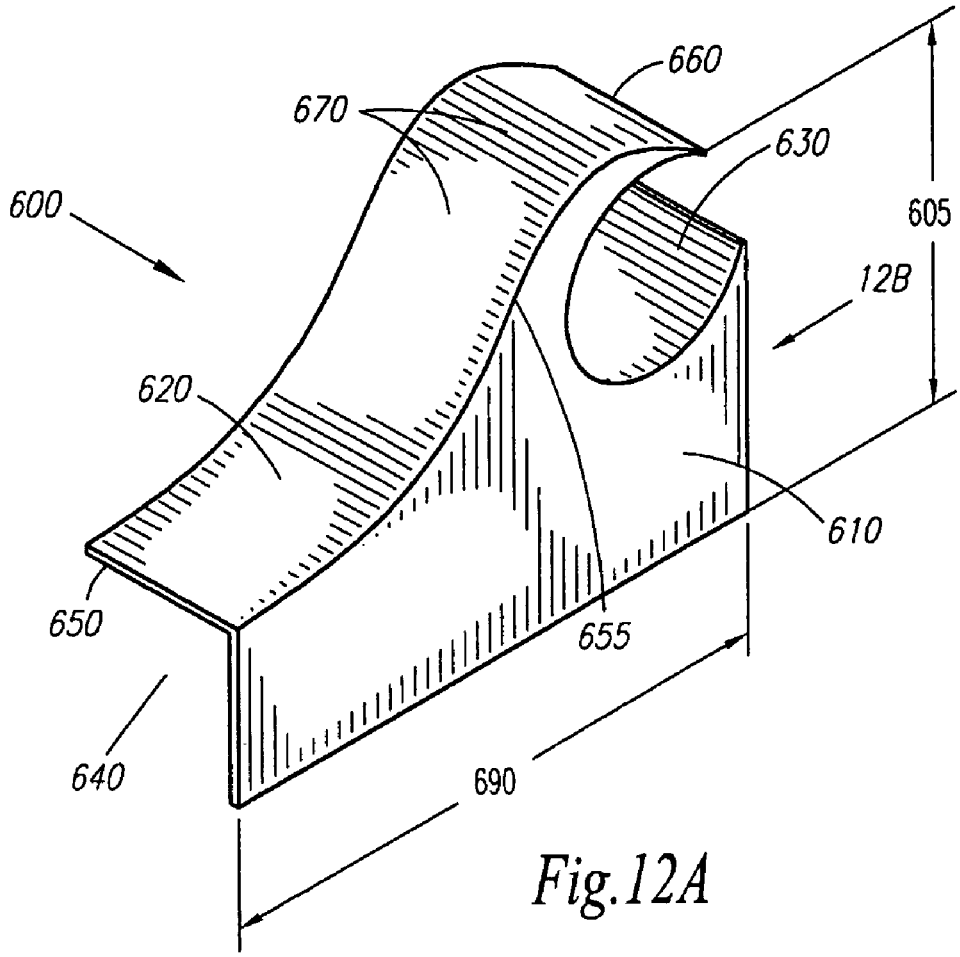
FIG. 12 includes schematic perspective and end views of a "two-sided" electrical connector of the invention.

In particular, an embodiment of connector 600, as depicted in FIG. 12, has a sidewall 610 and a curved top wall 620. Sidewall 610 includes a circular cutout forming circular receiver 630. Circular receiver 630 may be an entire circular cutout of sidewall 610 such that lead 400 inserted there into is fully surrounded by the receiver. Alternatively, circular receiver 630 may be a partial circle (a semicircular channel, or a channel having greater or less than half the circumference of a circle) to allow the insertion of lead 400. Top wall 620 extends from trailing edge 650 along a relatively flat plane to a curved plane 670 terminating in leading edge 660. Curve 655 and leading edge 660 are situated such that in the embodiment of FIG. 12A, side wall 610 appears to be a stylized ocean wave.

Figure 5C:
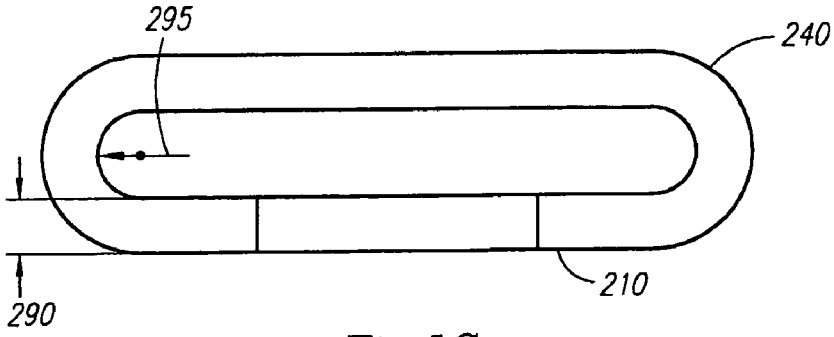
FIG. 5C is a schematic end-on view of a the inner coil after it is cut from the metal block.
Figure 12B:
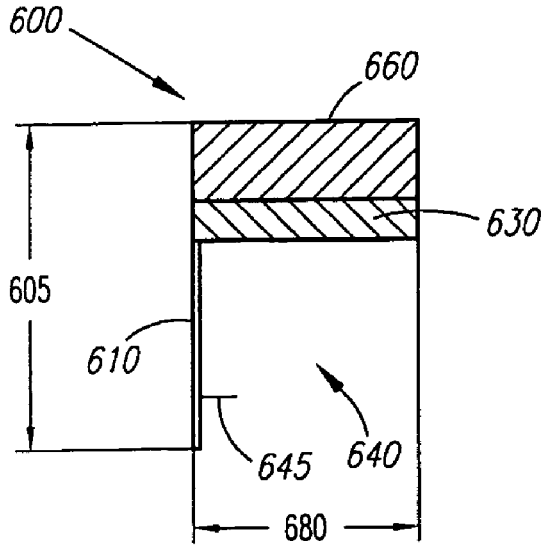
Figure 13A:
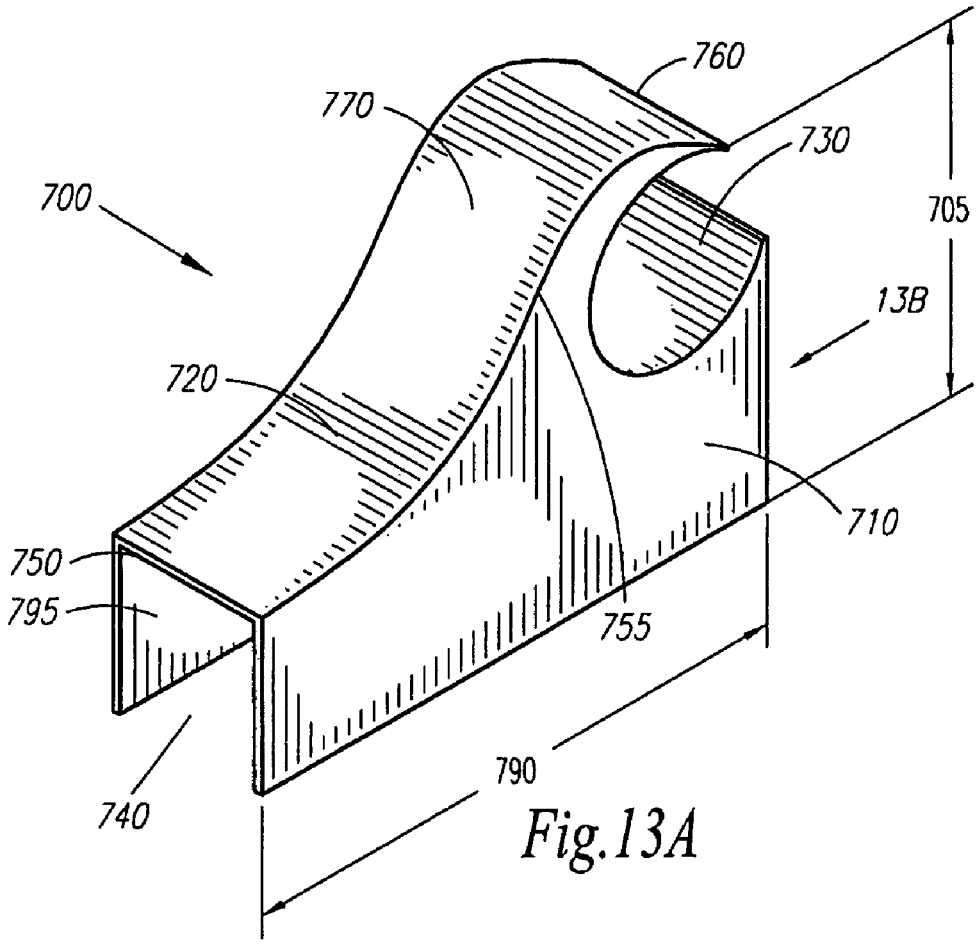
FIG. 13 includes schematic perspective and end views of a "three-sided" electrical connector of the invention.
Figure 13B:
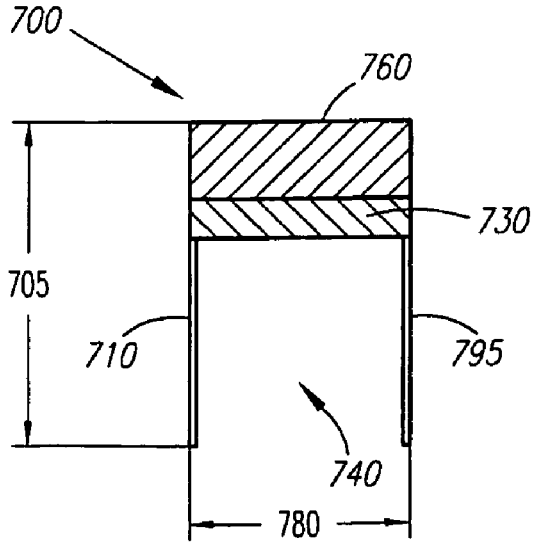

In FIGS. 12 and 13, the connector 600, 700 has a height 605, 705 which is generally less than the sum of the coil loop thickness 290 plus twice the inner coil radius 295, the latter two as shown in FIG. 5C. The length 690, 790 of connector 600, 700 is less than the length of the straight portion of coil end 220 signified by 225 in FIG. 7. Inner width 680, 780 (FIGS. 12B and 13B) of engaging portion (640, 740) of connector 600, 700 corresponds to the width of a coil, (W) 260, in FIG. 8. The "two-sided" connector 600 may optionally include a mounting tab 645 extending inward from, and running the length of, sidewall 610. Mounting tab 645 will advantageously extend into engaging portion 640 of connector 600 in order to more securely mount this two-sided embodiment of the connector on inner coil 240. The length 690 of connector 600 is not especially critical, but should be less than the sum of L+R as shown in FIG. 5A.

An alternative embodiment of connector 600 is shown as reference numeral 700 in FIG. 13. Reference numerals for features of connector 700 analogous to those of connector 600 have 100 added to the reference numeral thereof. Connector 700 has a first sidewall 710, a second sidewall 780 and a curved top wall 720. Sidewalls 710 and 790 include a circular cutout forming circular receiver 730. Circular receiver 730 may be an entire circular cutout of sidewalls 710 and 780 such that lead 400 inserted there into is fully surrounded by the receiver.

Alternatively, circular receiver 730 may be a partial circle (a semicircular channel, or greater or less than half the circumference of a circle) to allow the insertion of lead 400. Top wall 720 extends from trailing edge 750 along a relatively flat plane to a curved path 770 terminating in leading edge 760. The curve 770 and leading edge 760 are situated such that in the embodiment of FIG. 13*a*, side walls 710 and 790 appear to be a stylized ocean wave.

Broadly speaking, a connector of the invention may be a "two-sided" connector as depicted by reference numeral 600, or a "three-sided" connector as depicted by reference numeral 700. One side may be curved, and the channel receiving an electrical lead may be semicircular.

Figure 14:
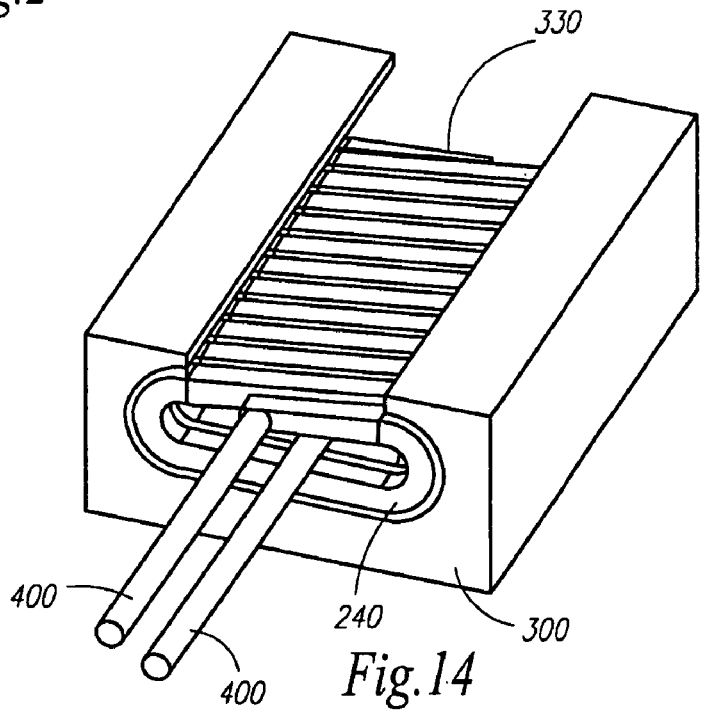
FIG. 14 is a schematic perspective view of the inner coil placed within the outer coil, and leads from the inner coil.

Coil Construction. To continue the process of making the HVMF coil of the invention, coated inner coil 240 is inserted back into outer coil 300, as schematically shown in FIG. 14. The straight slots 270 (FIG. 7) are located closest to the rectangular opening 330 in outer coil 300 (FIG. 5B). The inner coil 240 is shimmed within the outer coil to ensure no contact between the two and an equidistant separation between the inner and outer coils.

An infiltrant, preferably a polymeric material or resin 500 is injection molded into the rectangular opening 330 ensuring full coverage of the inner coil 240 and interior cavity 305 of outer coil, thus transforming the assembly of FIG. 14 to the finished actuator of FIG. 2. After the entireties of the cavities of the inner and outer coils are full of resin, the resin is cured, either thermally or chemically. Such resin may also be molded or otherwise formed around the entire outer coil as well as inside the internal spaces. The infiltrant 500 serves to physically stabilize the position of the inner coil 240 and it electrically insulates the inner coil 240 from the outer coil 300. The entire assembly of inner and outer coils, leads and cured resin is now the HVMF actuator of the invention, and is ready for use.

A benefit of the invention is that, in processing workpieces with intricate designs and/or stampings—instead of requiring the use of both male and female dies, which wear out quickly and drive up production costs—the HVMF actuator of the invention can be used together with a female die alone. The female die is stationary, and the HVMF actuator accelerates the workpiece to strike the female die thereby forming the stamped design. Actuator assemblies of the invention have been run over 1000 cycles without failure. Prior art coil designs using metal windings (instead of coils machined from a block of metal), have experienced failure after a single work cycle.

Cooling. With HVMF, and EMF in general, high temperatures can be generated, thus necessitating a need for cooling. U.S. Pat. No. 3,842,630 suggests a method of cooling an electromagnetic forming apparatus by routing coolant through channels machined inside the coil. U.S. Pat. No. 3,195,335 discloses pumping coolant to the turns of an electromagnetic forming coil. U.S. Pat. No. 6,875,964 discloses methods and apparatus for cooling an EMF actuator using liquid and/or gaseous coolant to disperse heat generated during EMF operations. In the simplest case, air can be used to cool the assembly.

Power Source. The power source may be selected from any power source capable of providing an electric current pulse of sufficient strength and duration to induce a work-force appropriate to form the workpiece into the desired shape. Such parameters are well known to those skilled in the art. Examples include current pulses in the range of 5 KA-100 KA for times in the range of 1-100 milliseconds. For instance, the power source may be in the form of a charged capacitor bank.

Pulsed power sources such as those available from Pulsar Magnetic Pulse Systems, of Yavne, Israel, are suitable. A magnetic pulse system includes an operator panel, a control cabinet, a pulse generator, and a work station, where the magnetic field is applied to the workpiece. A cooling system is advantageously included because of high temperatures generated.

Method of Forming Metal. The HVMF coils of the invention are used to form metal workpieces. A workpiece may be formed directly, that is, by application of a current to a HVMF actuator, thereby inducing an electrical field in an adjacent workpiece, and setting up a magnetic field in the workpiece opposite to that of the actuator. The workpiece field includes eddy currents having associated therewith a magnetic field that is repulsive to that of the coil. This natural electromagnetic repulsion is capable of producing very large pressures that can accelerate the workpiece at high velocities (typically 1-200 meters/second). This acceleration is produced without making physical contact with the workpiece. The electrical current pulse is usually generated by the discharge of a capacitor bank. It can provide: improved formability, improved strain distribution, reduction in wrinkling, active control of springback and the possibility of local coining and embossing.

When used for direct forming, a capacitor is discharged through the inventive coil herein. The interaction between the helical coil and a tubular metal workpiece produces a repulsive magnetic force between them. The pulse forces the workpiece onto a die. In a single operation, the workpiece is shaped in response to the die. A metal workpiece can also be perforated by direct forming.

When used for indirect forming, a capacitor is discharged through a flat coil. The flat coils produce a powerful magnetic field, which impacts on a transducer ("shock cone"). Elastic media disposed along the workpiece applies a uniform pressure over the workpiece and the latter is pressed onto a die.

An embodiment of the invention is a process of forming metal comprising: selecting a workpiece having a composition, selecting a compatible HVMF actuator including a power source, selecting a forming die, spatially arranging the workpiece, actuator, and die, and applying power to the power source of the actuator to deform the workpiece.

"Selecting a compatible HVMF actuator" may include (1) determining the composition of the workpiece, (2) selecting a metal from which to make the actuator based on necessary deforming forces to be applied to the workpiece, and (3) fabricating an actuator. It may be advantageous to apply at least a partial vacuum to the area contiguous with the workpiece to remove moisture-laden air from area around coils to promote a more stable and uniform magnetic field.

A continuous feed apparatus may be included in the processing steps herein. Indeed, two continuous feed rolls set up perpendicular to one another can advantageously improve throughput speeds as well as consistency of finish of the formed product.

Figure 15A:
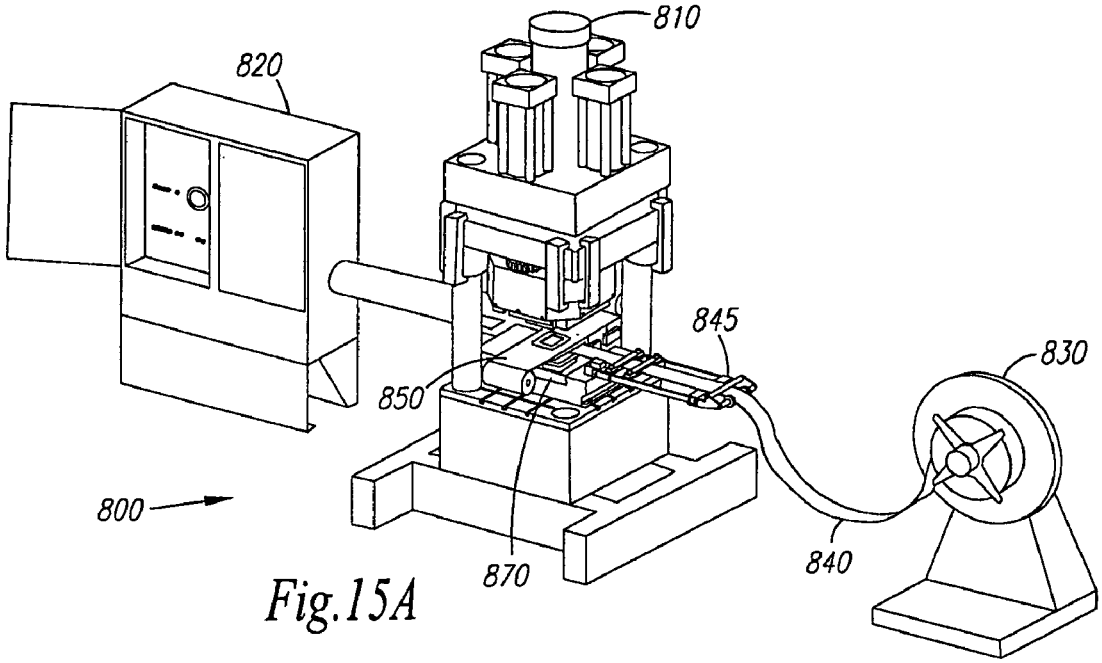
FIG. 15 includes schematic perspective and close up views of a HVMF production system of the invention.

In particular, the HVMF process of the invention may advantageously employ a production line including a hydraulic press. In FIG. 15A, a workpiece production line 800 includes, in addition to a HVMF actuator (or UP actuator), which is equivalent to 100 in FIG. 2, a hydraulic press 810, power source 820, a workpiece source roll, exemplified by uncoiler 830, at least one workpiece 840, a workpiece feed system 845, at least one backing sheet ("driver") 850, including a magnetically susceptible metal (for use when non-magnetically susceptible workpieces are processed) an optional driver handling system, typically a source roll and collection roll to hold used drivers. Power source 820 for the HVMF actuator may include a capacitor bank and associated power couplings. A forming operation envisioned herein may include one or more EMF steps and one or more physical forming steps, an example of which follows.

Figure 15B:
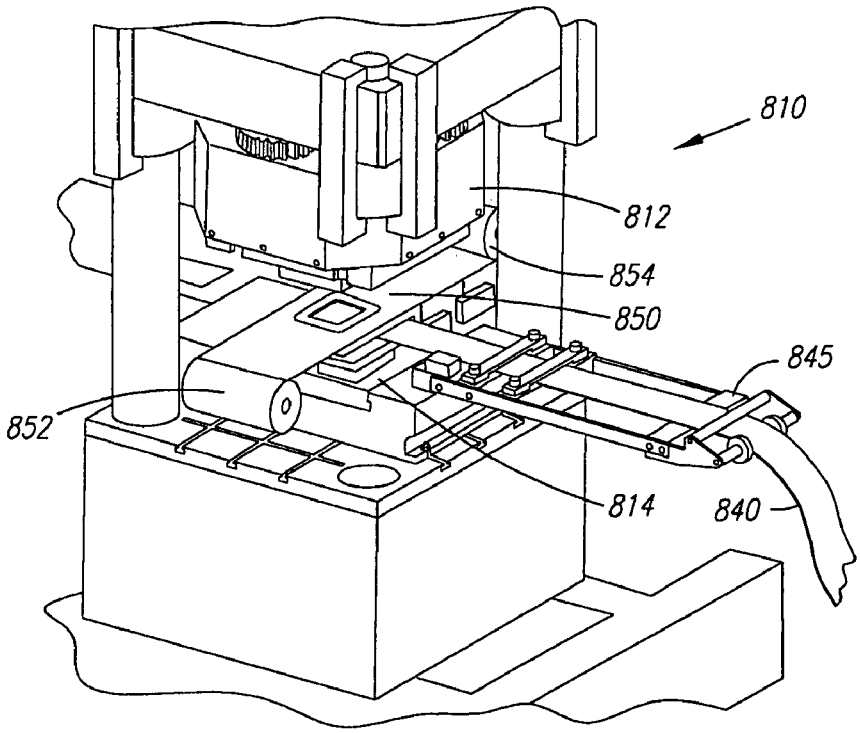

As noted in FIG. 15B, workpiece feed system 845 indexes a plurality of workpieces 840 from uncoiler 830 between press head 812 and press bed 814 of press 810. For an EMF operation, UP actuator 870 is activated by application of electric power from power source 820. The UP actuator 100 produces a transient magnetic field that induces eddy currents in the workpiece 840 (or driver 850). The currents in the actuator 870 and the workpiece 840 travel in opposite directions, thereby applying a deformation force to the workpiece 840, forcing it against the surface of the press head 812 such that the workpiece assumes the shape of the press head to provide a formed part.

For physical forming, press head 812 moves toward press bed 814, forcing workpiece 840 into contact with press bed 814, and causing workpiece 840 to assume a shape complimentary thereto. If workpiece 840 is non-magnetic (non-conductive), a magnetic (conductive) backing sheet ("driver") 850 is used. Close up views of press 810, feed system 845, and driver(s) 850 are shown in FIG. 15B. Drivers 850 originate at a driver source roll 852 and are taken up on driver collection roll 854. Drivers 850 are indexed perpendicular to the feed direction of workpieces 840. Because the applicable magnetic forces are repulsive, a driver 850 is positioned between a workpiece and the UP actuator, while the workpiece is between the driver and a press head 812 or other die. When the UP actuator is energized, the repulsive magnetic forces induced in the driver 850 carry the workpiece 840 away from the UP actuator and toward the press head 812 or other die, thereby forming said workpiece. In such case, driver 850 is directly deformed by the magnetic strike and indirectly deforms workpiece 840 into the desired shape. Backing sheet collection roll 854 takes up the series of used backing sheets 850. Depending on the severity of the deformation energy, backing sheets 850 may be used more than once, thereby saving costs.

Broadly, a variety of forming methods are envisioned herein. For example. One or more EMF "strikes" may be used to form a metallic workpiece, in particular, a metal bipolar plate, as used in fuel cells. Alternately, a combination of one or more EMF strikes and one or more mechanical forming strikes may be used. Specifically, a forming line could be established that employs in a continuous or non-continuous manner one or more EMF forming coils and one or more conventional forming operations, such as, for example a mechanical press.

It is believed that EMF may also be used to apply a membrane electrode assembly (MEA) materials to a workpiece, in particular, to a bipolar plate. In general, forming, joining, and coating of workpieces (e.g., bipolar plates) is envisioned, also when the workpieces are stored on a source roll or an uptake roll, before or after processing. EMF may also be used to effectuate joining of two workpieces, for example, at least one bipolar plate to another workpiece. Other joining techniques envisioned include solid state welding, solid state brazing using deposition of a nano-particulate metal (noble or other metal), formation of an interference joint, and combinations of the foregoing. Combinations of UP actuators and traditional EMF actuators may be used. Another process envisioned is the formation of rolls, strings, strips or sheets of continuous and adjoining workpieces, where the workpieces are easily separable from the toll. That is, formation of perforations at period intervals along the length of a roll of workpieces to facilitate easy tear-off, conceptually similar to a roll of paper towels.

Figure 16A:
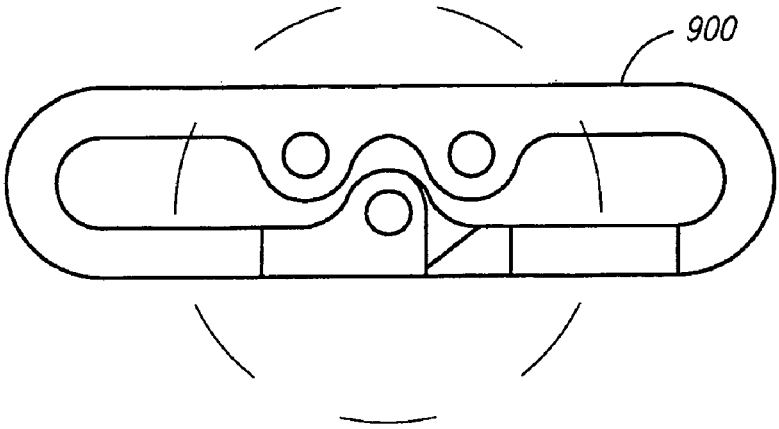
FIG. 16 includes views of an embodiment of the inner coil and attachment points for a structure enhancing truss.
Figure 16B:
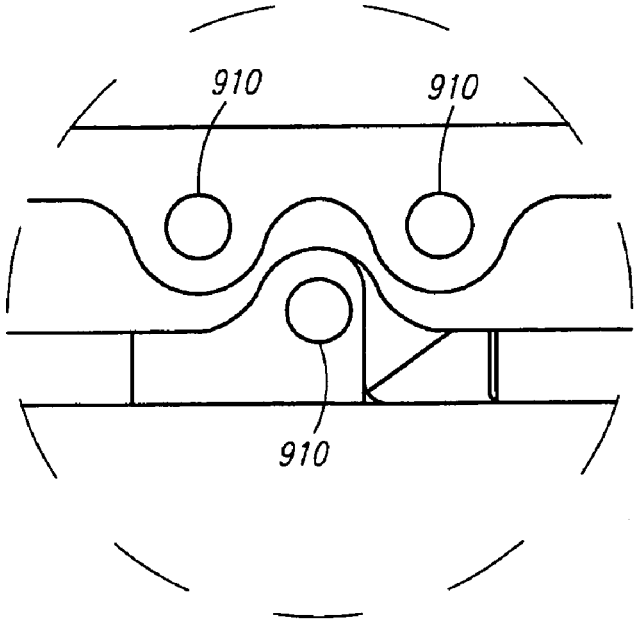
Figure 17A:
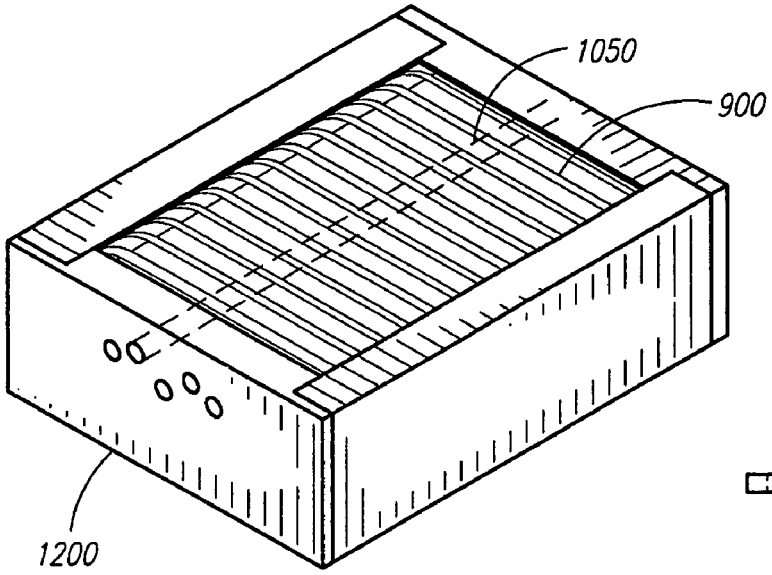
FIG. 17 includes a series of views of the inner coil, truss, outer coil and outer housing.
Figure 17B:
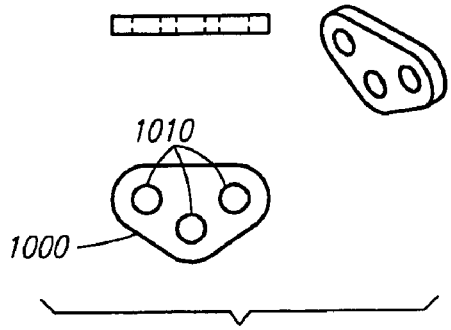

Another embodiment of the HVMF actuator of the invention is depicted in FIG. 16, which includes FIGS. 16A and 16B. FIG. 16A is a schematic end view of am embodiment of the invention, in particular inner coil 900 (similar to inner coil 240 previously described). FIG. 16B is a close up of a portion of the view of FIG. 16A. FIG. 16B focuses on an embodiment of coil 900 including three attachment points 910, used to secure a triangular truss 1000, shown in FIG. 17B. Preferably, truss 1000 is made of a non-magnetic material and serves to enhance and maintain the structural integrity of inner coil 900 as well as to hold inner coil 900 within an outer coil such as outer coil 300. Truss 1000 includes attachment points 1010 corresponding to coil attachment points 910. Attachment points 910 may take the form of male protrusions that fit into correspondingly sized truss attachment points 1010. One or more such trusses 1000 may be used within a single actuator. In one embodiment, a plurality of trusses 1000 are distributed among the individual turns of coil 900, preferably at regular intervals. In such case, the trusses 1000 are secured to the coil 900 by one or more non-magnetically susceptible rods or connectors. Such rods may extend a portion or the entire length of coil 900. Such rods are advantageously fabricated out of a high-melting plastic such as polycarbonate or ABS.

Figure 17C:
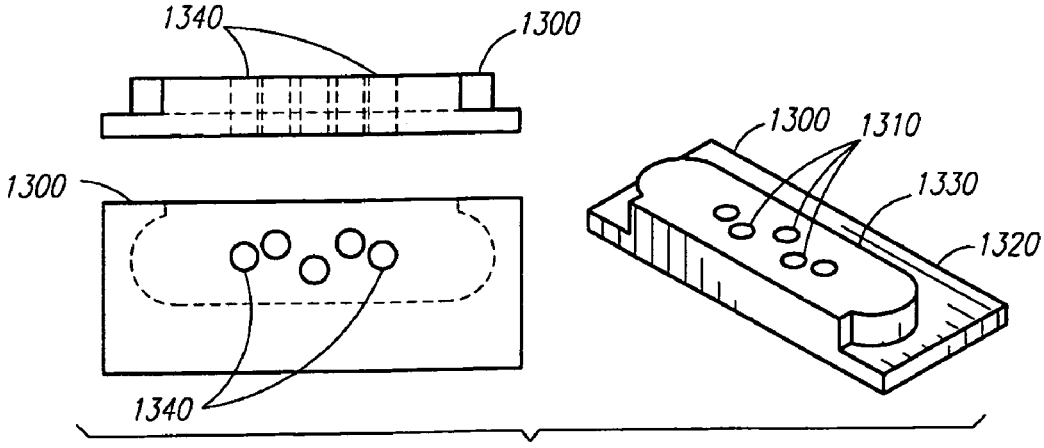

Inner coil 900 generally rests within an outer coil such as 300, from which inner coil 900 is cut, as previously described. The assembly of inner coil 900 and outer coil 300 may rest within a container, an example of which is container 1200, FIG. 17A. The container may generally take the shape of a rectangular box having at least one removable end piece 1300, in FIG. 17C.

One embodiment of a removable end piece 1300 includes a flat rectangular portion 1320 on which a generally oval/elliptical portion 1330 having a greater thickness than 1320 is situated. Oval portion 1330 takes the same general shape and size of an end face of coil 900. In principle, end piece 1300 is machined from a single block of material (or so molded). End piece 1300 may advantageously include connections 1310 drilled into or through it, corresponding to truss connecting points 1010 and inner coil connection points 910. At least one aforementioned connecting rod may pass through all of 910, 1010, and 1310 to lend added structural integrity to an entire inner/outer coil assembly. End piece 1300 may also include through holes 1340 generally situated to allow the passage of leads from a power source (not shown in FIG. 17, but similar to leads 400 in FIGS. 2, 10, and 11).

It is noted that dimensions in the drawings are exemplary and do not limit the invention.

Additional advantages and modifications will readily occur to those skilled in the art. Therefore, the invention in its broader aspects is not limited to the specific details and illustrative example shown and described herein. Accordingly, various modifications may be made without departing from the spirit or scope of the general invention concept as defined by the appended claims and their equivalents.

What is claimed is:

1. A coil assembly for use in high velocity metal forming comprising:

a. an inner coil, generally in the shape of a flattened helix, b. an outer coil having a cavity therein, the inner and outer coils being generally coaxial, c. leads connecting the inner coil to an outside electrical power source, and d. an infiltrant, wherein the inner coil is embedded in the infiltrant, and situated inside the cavity of the outer coil such that the inner and outer coils are not in electrical contact with one another, and wherein the cavity of the outer coil is substantially filled with the infiltrant.

2. The coil assembly of claim 1, wherein the inner and outer coils are both cut from the same solid block of a metal or an alloy.

3. The coil assembly of claim 1, wherein the inner coil includes a dielectric coating and the inner and outer coils comprise copper.

4. The coil assembly of claim 3, wherein the inner and outer coils further comprise beryllium.

5. The coil assembly of claim 1, wherein the assembly has X, Y, and Z dimensions, wherein the inner coil comprises parallel straight sides having straight gaps therebetween and parallel angled sides having angled gaps therebetween, the angled sides disposed at an angle of 5 to 85° with respect to the straight sides, the straight and angled sides being connected with semicircular end caps therebetween.

6. The coil assembly of claim 5, wherein the straight and angled gaps are formed by a procedure selected from the group consisting of CNC machining, wire EDM and laser cutting.

7. A process of electromagnetic forming comprising:

a. providing a piece of sheet metal;

b. providing the coil assembly of claim 1;

c. providing a die having a cavity formed in a surface thereof; such that the workpiece is disposed between the coil assembly and the cavity of the die; and, d. electrically energizing the coil assembly and inducing a force into the workpiece such that it moves against the surface of the die and assumes the shape of the die cavity, thereby providing a formed workpiece.

8. A process for making a high velocity metal forming actuator assembly wherein the assembly comprises an inner coil and an outer coil, the process comprising:

a. forming a hole through a block of conductive metal or alloy, the block having X, Y, and Z dimensions, said hole being formed in a Z dimension;

b. beginning at the hole, cutting out a continuous central portion of the block corresponding to a desired inner dimension of an inner coil, said cutting being parallel to the Z-axis;

c. cutting out a further portion of the block parallel to the Z-axis to form an inner coil, the remainder constituting an outer coil having a cavity;

d. machining angled notches in a +Z portion of the inner coil at regular intervals along the X-axis, said angled notches being cut at an angle of 0 to 90° from the X-axis;

e. machining straight/parallel slots in a −Z portion of the inner coil, said straight slots being parallel to the Y-axis, to afford an inner coil;

f. contacting the inner coil with a solution capable of removing surface oxidation therefrom;

g. inserting the inner coil into the cavity of the outer coil, and h. filling the gap in the cavity of the outer coil and surrounding the inner coil with an infiltrant.

9. The process of claim 8, wherein the cutting of at least one of step (b) or step (c) is by wire EDM or laser.

10. The process of claim 8, wherein the conductive metal is a beryllium-copper alloy.

11. The process of claim 10, wherein the beryllium-copper alloy comprises about 0.1 to about 2 wt % of beryllium and about 95 to about 99.5 wt % copper.

12. The process of claim 11, wherein at least one of the angled notches of (d) and the angled notches of (e) are machined by CNC machining.

13. The process of claim 8 further comprising between (f) and (g), (f1) covering the inner coil and at least a portion of the outer coil with a dielectric material.

14. The process of claim 13, wherein the dielectric material comprises a bisphenol-A epoxy resin.

15. The process of claim 13, wherein the coil assembly includes an inner coil coated with dielectric material that includes a nine-type bisphenol-A epoxy resin and a one-type bisphenol-A epoxy resin.

16. The process of claim 15, wherein the dielectric material further comprises a crosslinker.

17. A process of forming metal comprising:

a. selecting a workpiece having a composition, b. selecting a compatible HVMF actuator assembly including a power source and a coil assembly, c. selecting a forming die, d. spatially arranging the workpiece, coil assembly, and die, wherein the coil assembly comprises an inner coil disposed inside an outer coil and an infiltrant disposed around the inner coil and electrically insulating the inner coil from the outer coil, and e. applying power to the power source of the coil assembly to deform the workpiece.

18. The process of claim 17, wherein selecting a compatible HVMF coil assembly includes (1) determining the composition of the workpiece, (2) selecting a metal from which to make the coil assembly based on necessary deforming forces to be applied to the workpiece, and (3) fabricating the coil assembly.

19. The process of claim 17, wherein at least a partial vacuum is applied to an area contiguous with the workpiece to remove moisture-laden air from regions around the coils to promote a more stable and uniform magnetic field.

20. The process of claim 17, further comprising:

f. further forming the workpiece in a mechanical forming press.

* * * * *